United States Patent [19]

Baugh et al.

[11] Patent Number: 4,842,069

[45] Date of Patent: Jun. 27, 1989

[54] APPARATUS AND METHOD FOR CEMENTING A LINER IN A WELL BORE

[75] Inventors: John L. Baugh, Houston; David L. Nevels, The Woodlands, both of Tex.

[73] Assignee: Baker Hughes Incorporated, Houston, Tex.

[21] Appl. No.: 147,699

[22] Filed: Jan. 25, 1988

[51] Int. Cl.[4] ..... E21B 33/16

[52] U.S. Cl. ..... 166/285; 166/291; 166/155; 166/156

[58] Field of Search ..... 166/285, 291, 383, 124, 166/127, 153, 155, 156, 192, 193, 154

[56] References Cited

U.S. PATENT DOCUMENTS

| | | | |
|---|---|---|---|
| Re. 29,830 | 11/1978 | Scott | 166/155 |
| 2,249,511 | 7/1941 | Westall . | |
| 3,364,996 | 1/1968 | Brown | 166/120 |
| 3,545,542 | 12/1970 | Scott | 166/155 |
| 3,635,288 | 1/1972 | LeBourg | 166/291 X |
| 3,730,267 | 5/1973 | Scott | 166/291 X |
| 4,624,312 | 11/1986 | McMullin | 166/155 |

*Primary Examiner*—William P. Neuder

*Attorney, Agent, or Firm*—Charles D. Gunter, Jr.

[57] ABSTRACT

An apparatus and method are shown for cementing a liner in a well bore. An operating string of smaller diameter is inserted within the internal diameter of the liner. A setting tool initially connects the operating string within the liner and includes a plug carrying body at the lowermost extent. A top plug is releasably supported from the plug carrying body and a longitudinally spaced bottom plug is releasably supported from the top plug. A collet latch secures the top plug to the plug carrying body and a collet latch secures the bottom plug to the top plug. A shiftable sleeve positively locks the top plug to the plug carrying body until the collet latch securing the bottom plug is released.

10 Claims, 8 Drawing Sheets

APPARATUS AND METHOD FOR CEMENTING A LINER IN A WELL BORE

BACKGROUND OF THE INVENTION

1. Field of the Invention

This invention relates generally to equipment for cementing liners in well bores and specifically to a well bore-liner cementing apparatus having multiple liner wiper plugs for wiping the interior surfaces of the operating string and liner during cementing operations.

2. Description of the Prior Art

A liner is a section of casing or tubing which is suspended in a well without normally extending to the surface. Cemented liners are used for many purposes including well control and reducing the initial cost of casing. Liners may be installed entirely within outer casing strings or partially within the casing and partially within an open hole.

Conventionally, a liner is set and cemented by first lowering the liner and a setting tool connected to an operating string into the well bore. The liner is hung, usually on slips, and the setting tool is usually, but not always released from the liner. Cement is then pumped through the operating string, into the liner, and displaced from the liner, usually through a foot valve, into the annular space between the liner and the surrounding casing or well bore.

In most cases, a pump down plug is introduced into the liner string immediately behind the cement in order to separate the cement from the displacing fluid and to wipe the cement from the operating string and liner surface as the cement is pushed out of the liner into the surrounding annular space. Typically, the pump down plug which is to wipe the operating string and liner is pumped behind the cement until it engages a liner wiper plug and then the liner wiper plug and pump down plug are forced downwardly together in the liner string so as to displace the cement therefrom and to wipe the liner walls.

U.S. Pat. No. 3,910,349 to Joe R. Brown et al, entitled "APPARATUS AND METHOD FOR CEMENTING WELL LINERS", issued, Oct. 7, 1975, shows a liner cementing apparatus which includes a setting tool having a tubular mandrel connected in a pipe string for extension through the liner. A liner wiper plug is releasably disposed within the liner near one end of the mandrel. After the liner is hung in position in the well bore, the setting tool is unlatched and moved axially a few feet to indicate to the operator at the surface that disengagement of the setting tool has occurred. A pump down plug engages the liner wiper plug to wipe the interior of the operating string and liner behind the cement column.

It is also an advantage in well cementing operations to provide a cementing apparatus which utilizes multiple plugs to completely isolate the column of cement being pumped through the operating string and liner. U.S. Pat. No. 3,364,996, to C. C. Brown, entitled "Apparatus for Cementing Well Liners", issued Jan. 23, 1968, shows a cementing apparatus utilizing a total of four plugs to isolate the column of cement being pumped from well bore fluids both in front of and behind the column of cement. The present invention is an improvement to the device shown in U.S. Pat. No. 3,364,996, in that the top liner wiper plug is positively locked to the plug carrying body of the setting tool until the bottom wiper plug has been released. Both the top and bottom liner wiper plugs are positively locked to each other and to the setting tool until the pump down plugs land in their respective seats. Because of the positive lock features of the design, premature shear of either the top or bottom liner wiper plugs is prevented.

Additional objects, features and advantages will be apparent in the written description which follows.

SUMMARY OF THE INVENTION

The apparatus for cementing a liner of the invention includes a liner string insertible in a well bore and an operating string of smaller diameter than the internal diameter of the liner string and insertible therein. Means are provided for connecting the operating string within the internal diameter of the liner string which are operable by rotation of the operating string to release the operating string from the liner. A plug carrying body is connected to the lowermost extent of the operating string. A top liner wiper plug is releasably supported form the plug carrying body and a longitudinally spaced bottom liner wiper plug is releasably supported from the top plug. A pressure releasable collet latch secures the top plug to the plug carrying body and a pressure releasable collet latch secures the bottom plug to the top plug. A longitudinally shiftable top sleeve locks the top plug to the plug carrying body until the pressure releasable collet latch securing the bottom plug is released.

Preferably, the plug carrying body is provided with an internal recess and the top plug is provided with a plurality of upwardly extending collet fingers, each of the collet fingers terminating in a lug which is received within the internal recess when the top plug is secured to the plug carrying body. The top plug is also provided with a plurality of downwardly extending collet fingers, each of the fingers terminating in a lug. The bottom plug is provided with an internal recess and the downwardly extending lugs are received within the internal recess of the bottom plug when the bottom plug is secured to the top plug. A longitudinally shiftable bottom sleeve is located below the longitudinally shiftable top sleeve for initially locking the bottom plug to the top plug.

Preferably, the longitudinally shiftable bottom sleeve has an internal profile adapted to receive a first pump down plug propelled by pressure through the operating string to exert release pressure on the bottom sleeve. The bottom sleeve also has an exterior including a region of greater relative external diameter which initially underlies the downwardly extending collet lugs and a region of reduced external diameter. Downward movement of the bottom sleeve serves to bring the region of reduced external diameter into registry with the collet lugs to allow release of the bottom plug from the top plug.

The top sleeve has an internal profile which is adapted to receive a second pump down plug of greater relative diameter than the first pump down plug. This second pump down plug is propelled by pressure through the operating string to exert release pressure on the top sleeve. The top sleeve has an exterior region which initially underlies the upwardly extending collet lugs, downward movement of the top sleeve serving to release the upwardly extending collet lugs and, in turn, the top plug from the plug carrying body.

A landing collar is located in the liner below the lowermost extent of the operating string. The landing collar is provided with a plug catching profile for catching the bottom plug upon release of the bottom plug from the top plug. The bottom plug is provided with an internal landing profile which is engaged by the top plug upon release of the top plug from the plug carrying body. Preferably, a retaining ring is located within the interior of the bottom plug for supporting the bottom sleeve and first pump down plug within the bottom plug after release of the bottom plug from the top plug. Shear means connect the retaining ring with the bottom plug and are releasable upon pressuring the the interior of the operating string to a further, predetermined level, whereby the bottom sleeve and first pump down plug are released from the bottom plug to allow cement to be pumped through the bottom plug and through the liner.

DESCRIPTION OF THE PREFERRED EMBODIMENT

Referring to 2*a* and 2*b* there is shown a liner string 11 disposed near the bottom of a well bore. The well bore can be lined by a casing string 13, which can extend to the surface of the well. An annular space 15 is formed between the liner string 11 and the surrounding well bore defined by the casing 13.

Figure 2A:
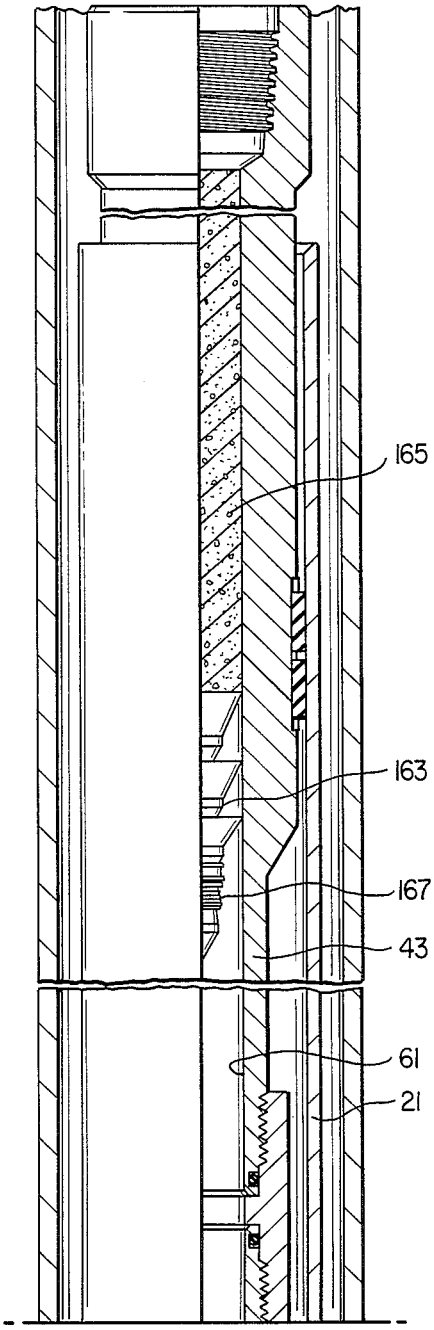
FIG. 2*a* shows the upper portion of a liner with the operating string of the invention in place within the liner and a pump down plug preceding a column of cement.

The liner string 11 includes a setting mechanism 17 (FIG. 2*c*), and a setting sleeve 19 joined by a coupling 20 to a setting sleeve extension 21 (FIG. 2*a*). At the lower end of the liner string 11 there is provided a standard landing collar 23 and a cementing shoe 25.

The liner setting mechanism 17 includes slips 27 and setting cones 29 by which the liner string is supported in the well bore. Such construction is well known in the industry and will not be described in detail here. The landing collar 23 is adapted to receive a liner wiper plug as will be more fully described. The cementing shoe 25 is provided with back pressure check valves 31, 33 which permit passage of cement from within the internal diameter 35 of the liner into the annular space 37 via the ports 39.

Figure 2B:
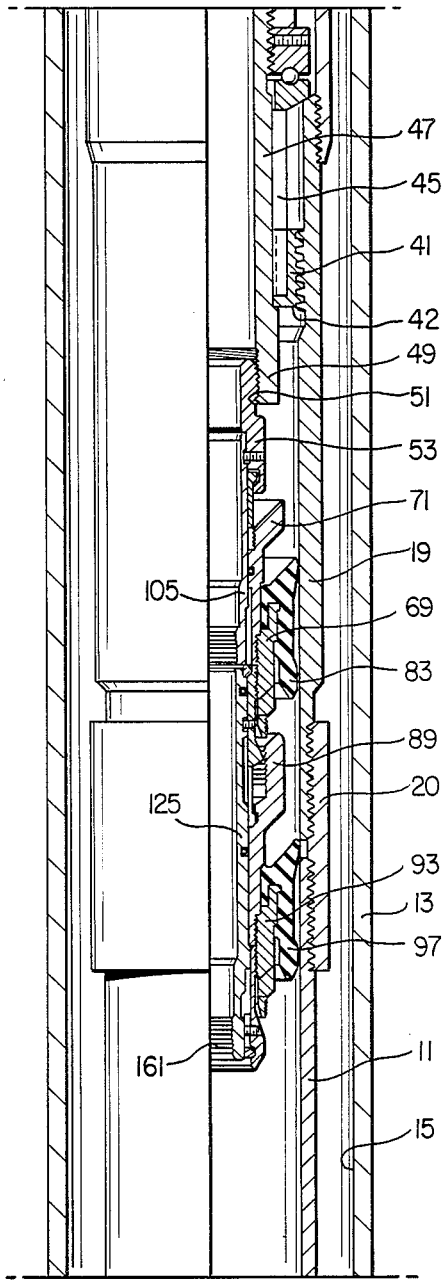
FIG. 2*b* is a downward continuation of the operating string and liner of the invention showing the plug assembly attached to the operating string.
Figure 2C:
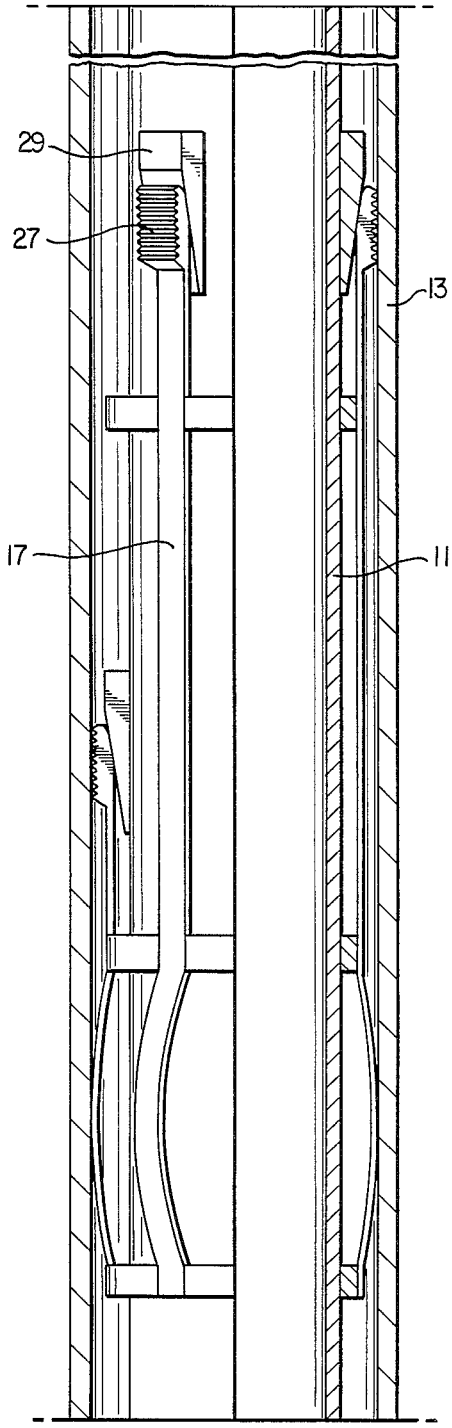
FIG. 2*c* is a downward continuation of the liner of FIG. 2*b* showing the slips used to hang the liner within the surrounding well casing.

As shown in FIG. 2*b*, the liner string 11 is initially attached by means of a rotatably releasable connector 41 to the operating string 43 which extends to the well surface. The rotatable connector 41 comprises a left-handed threaded nut which engages course left-hand threads 42 on the interior of the longitudinal slots for engaging corresponding splines 45 on the setting tool 47. Thus, rotation of the operating string 43 and the associated setting tool 47 in the right-hand direction will cause the nut 41 to move upwardly on the splines 45 to eventually disengage the threads 42 and the setting sleeve 19, effectively releasing the setting tool from the liner string. Setting tools of the type described are know in the art and are shown, for instance, in U.S. Pat. No. 4,441,560, issued to Baugh et al, entitled "Setting Tool", Apr. 10, 1984.

As shown in FIG. 2*b*, the lowermost extent 49 of the setting tool 47 has an internally threaded surface 51 for engaging a mating externally threaded surface of a plug carrying tubular body 53. The plug carrying body 53 forms the uppermost portion of the plug assembly used in the apparatus of the invention and shown in greater detail in FIGS. 1*a* and 1*b*.

Figure 1A:
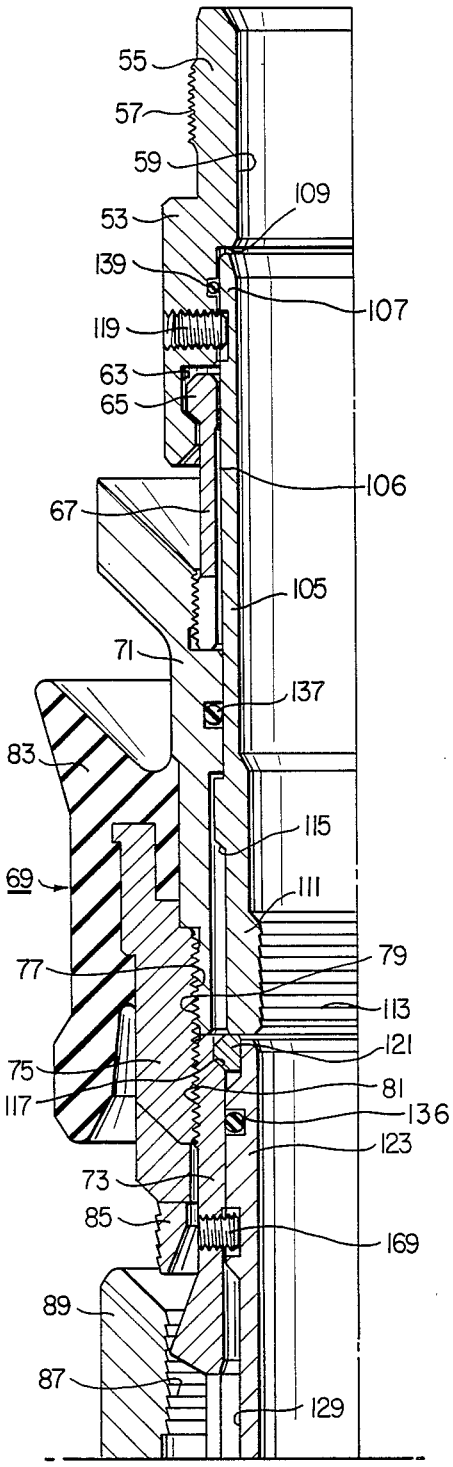
FIG. 1*a* is a cross-sectional view of the upper portion of a plug assembly of the type which connected to an operating string for use in the present invention.

As shown in FIG. 1*a*, the plug carrying body 53 includes an upper extent 55 with an externally threaded portion 57 for engaging the running tool threads and an internal bore 59 which communicates with the bore of the setting tool 47 and, in turn, with the bore 61 of the operating string 43. The plug carrying body 53 is provided with an internal recess, such as annular groove 63, for receiving the lugs 65 of upwardly extending collet fingers 67. The collet fingers 67 are used to releasably secure a top plug 69 to the plug carrying body 53. The top plug 69 includes an upper body portion 71, a lower body portion 73, and an intermediate connecting portion 75. The body portions intermediate connecting portion 75. The body portions are connected by means of mating threaded surfaces 77, 79 and 81, respectively. The intermediate portion 75 and upper body portion 71 carry a circumferential sealing element 83 which is used to wipe the interior of the liner during cementing operations. The intermediate portion 75 also includes a lower extent 85 having a serrated external surface for later engagement with an internal landing profile 87 (FIG. 1*a*) provided in the upper body portion 89 of a bottom plug 91. The bottom plug 91 has an intermediate body portion 93, a lower body portion 95 and an associated sealing element 97 similar to the arrangement of the top plug 69.

Figure 1B:
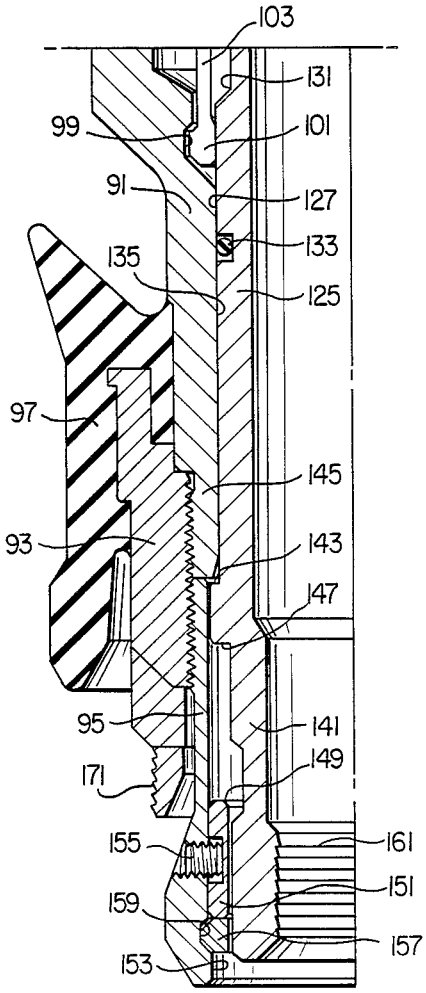
FIG. 1*b* is a downward continuation of the assembly of FIG. 1*a*.

As shown in FIGS. 1*a*and 1*b*, the bottom plug 91 has an internal recess, such as annular groove 99 for receiving the lugs 101 of downwardly extending collet finger 103. The collet fingers 103 depend from the lower body portion 73 of the top plug and provide a pressure releasable means for securing the bottom plug to the top plug.

The top plug 69 is mechanically locked to the plug carrying body 53 prior to the release of the bottom plug 91 by means of a longitudinally shiftable top sleeve 105.

The top sleeve 105 has an upper extent 107 which abuts an internal shoulder 109 provided in the plug carrying body 53 and has a lower extent 111. The exterior surface 106 of the upper extent 107 initially underlies the lugs 65 of upwardly extending collet fingers 67 to lock the top plug 69 to the plug carrying body 53. The lower extent 111 is provided with an down plug, as will be described. The lower extent 111 of the top sleeve 105 includes a shoulder region 115 for contacting a mating shoulder 117 provided in the lower body portion 73 of the top plug 69. The top sleeve 105 is initially retained in the position shown in FIG. 1*a* by means of shear screws 119 and a snap ring 21.

The snap ring 121 has an external profile which mates with the shoulder 117 and is retained in the expanded position shown in FIG. 1*a* by contact with the upper extent 123 of a longitudinally shiftable bottom sleeve 125. The bottom sleeve 125 has a region of increased external diameter 127 which joins a region of decreased external diameter 129 to form an external shoulder 131. The region of increased diameter 127 initially underlies the lugs 101 of the bottom plug 91 to thereby releasably secure the bottom plug 91 to the top plug 69. An O-ring 133 carried in a groove on the bottom sleeve 125 seals within the bore 135 of the bottom plug 91. Similarly, O-rings 136 and 137 seal between the top plug and top sleeve 105 and O-ring 139 seals between the top sleeve 105 and plug carrying body 53.

The bottom sleeve 125 has a lowermost extent 141 provided with in an external shoulder 143 which initially abuts a mating shoulder provided in the portion 145 of the bottom plug 91. The lower most extent 141 also has an oppositely arranged external shoulder 147 which is adapted to engage the upper surface 149 of a retaining ring 151 which is located within the interior 153 of the lower body portion 95 of the bottom plug 91. The retaining ring 153 is supported in the position shown by means of shear screws 155 and a snap ring 157 which is initially located within an annular groove 159 provided in the interior 153. The bottom sleeve 125 has a serrated interior surface 161 which is similar to surface 113 of the top sleeve 105 but of a smaller relative internal diameter.

The operation of the apparatus of the invention will now be described. FIGS. 2*a* and 2*b* show the device of the invention as it would appear at the initial stage of the cementing operations. The setting mechanism 17 has been actuated (FIG. 2*c*) so that the cones 29 cause the associated slips 27 to grip the surrounding casing 13 to anchor the liner into position. After the liner has been hung in the conventional manner, circulation is established by pumping circulating fluid through the operating string 43, through the setting tool 47, through the liner string 11, and through the shoe 25 into the annular space 37 surrounding the liner.

Figure 2D:
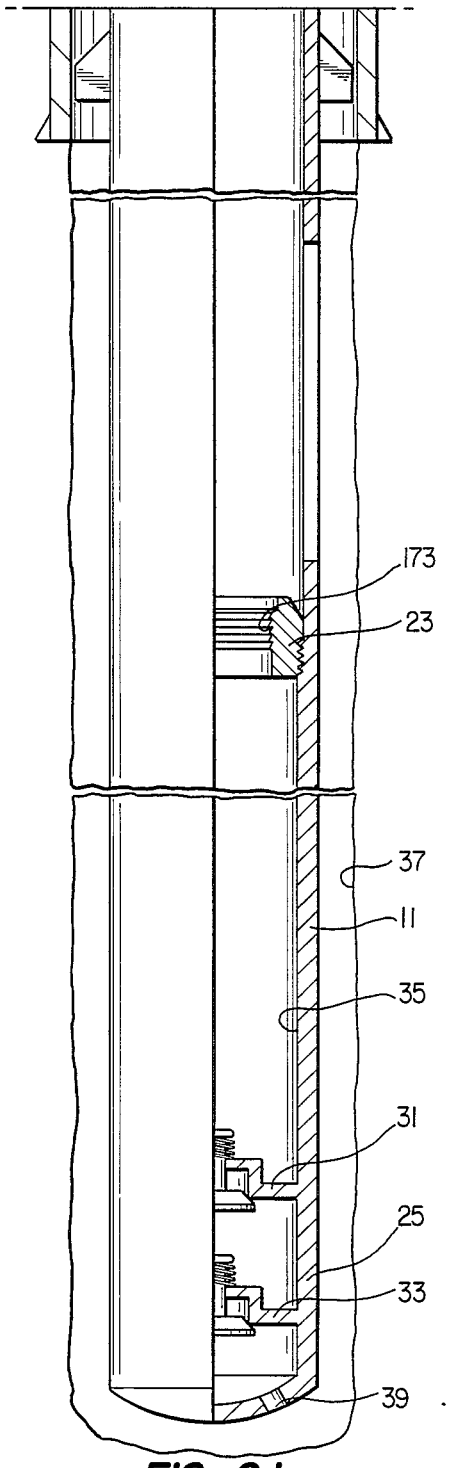
FIG. 2*d* is a downward continuation of the liner of FIG. 2*c* showing the foot valve thereof.

After circulation has been established, the setting tool 47 can be released from the liner string 11 by rotating the operating string in the right-hand direction to release the splined nut 41. The operating string is then typically lifted a few feet to insure that release has been effected. A first pump down plug 163 is then pumped behind the circulating fluid and in front of a properly measured amount of cement 165. The conventional pump down plug 163 is adapted to slide and seal within the bore 61 of the operating string 43. The pump down plug 163 includes a nose portion 167 with a frictional engagement surface thereon sized and adapted to engage the serrated interior surface 161 of the bottom sleeve 125 to latch the pump down plug within the bottom sleeve. A pump pressure increase of approximately 1,000 psi will then shear the first set of shear screws 169 which connect the bottom sleeve 125 to the top plug. The bottom sleeve 125 then moves downwardly until shoulder 147 contacts the upper surface 149 retaining ring 151. This movement brings the region of decreased external diameter 129 beneath the collet lugs 101, thereby allowing the collet to collapse and release the bottom liner wiper plug 93. Bottom plug 91 then travels down the interior of the liner string until externally serrated surface 171 (FIG. 1*b*) latches within the internally serrated surface 73 (FIG. 2*d*) of the landing collar 23. FIG. 3*d* shows the bottom plug 93 and the associated first pump down plug 163 latched within the landing collar 23. As shown in FIG. 3*b*, the top plug 69 is still connected to the plug carrying body 53.

Figure 4A:
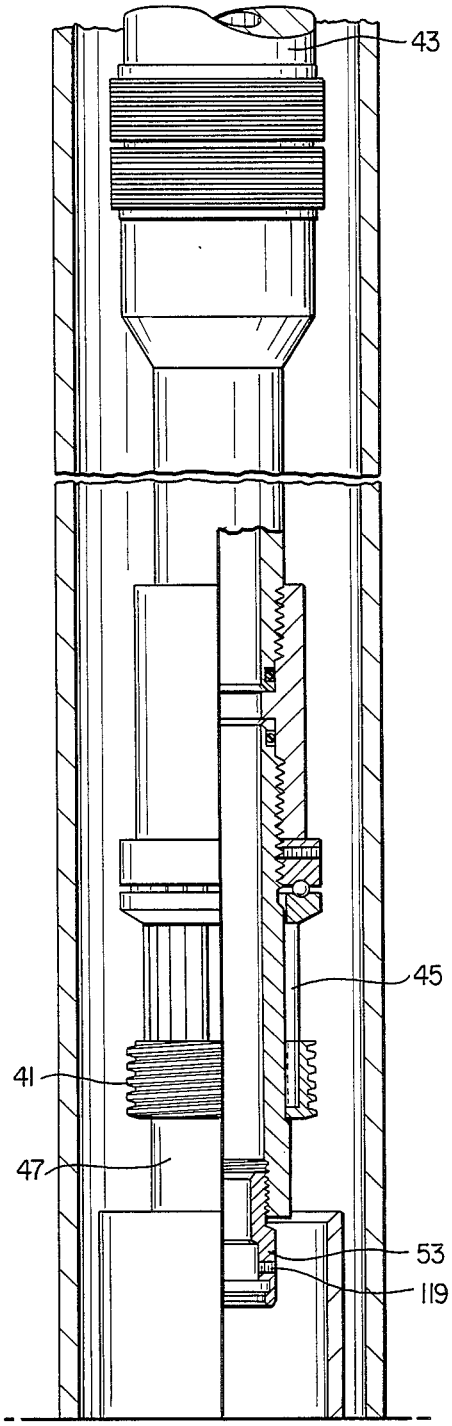
FIG. 4*a* shows the retrieval of the operating string from cemented liner.
Figure 4B:
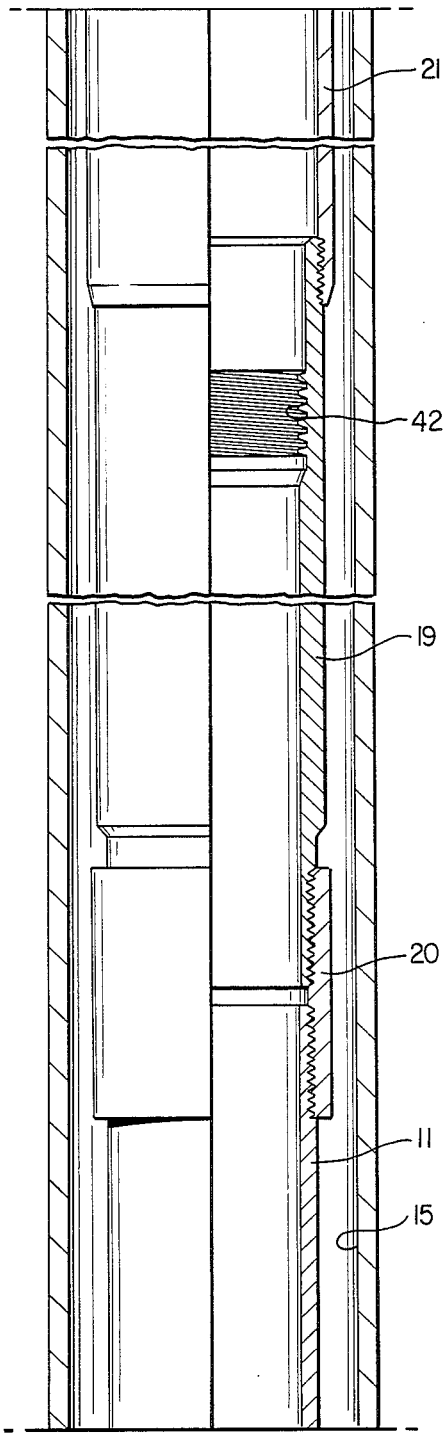
FIG. 4*b* is a downward continuation of the FIG. 4*a*.
Figure 4C:
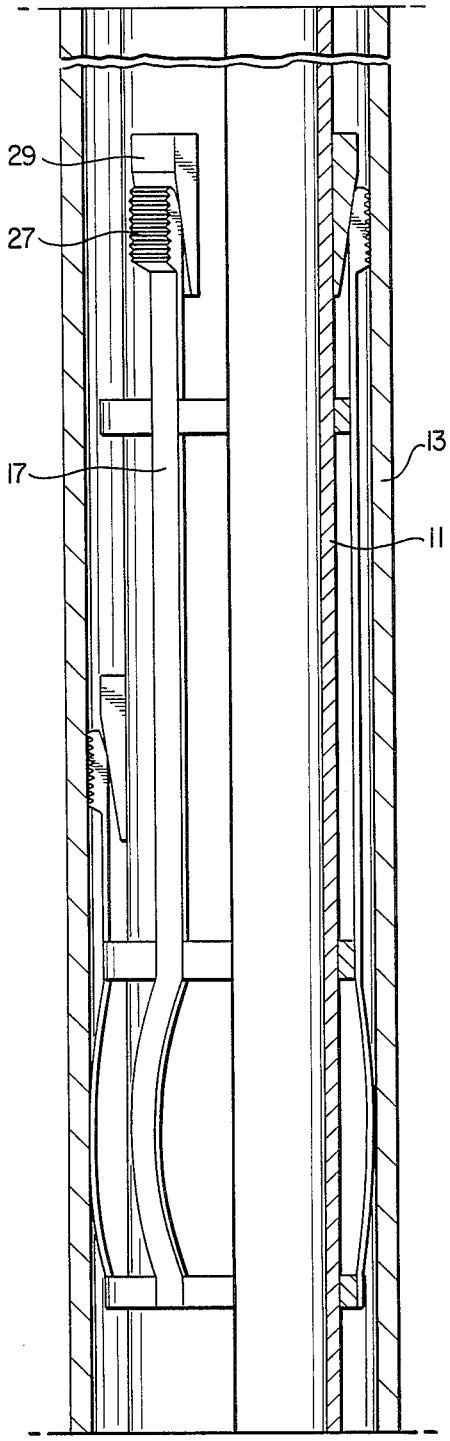
FIG. 4*c* is a downward continuation of FIG. 4*b*.
Figure 4D:
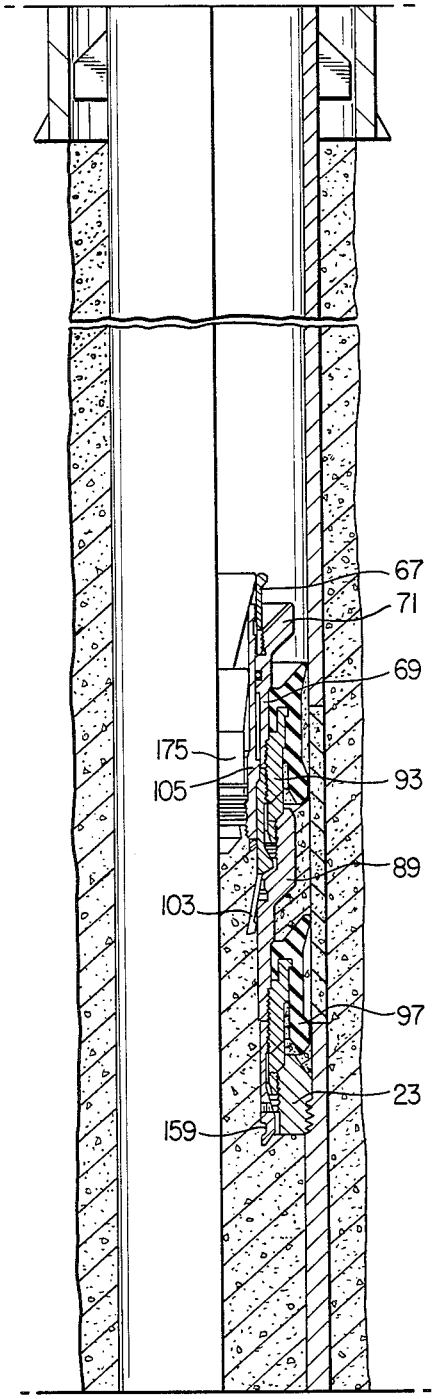
FIG. 4*d* is a downward continuation of FIG. 4*c* showing the plug, seated within the bottom plug at the conclusion of the cementing operation.
Figure 4E:
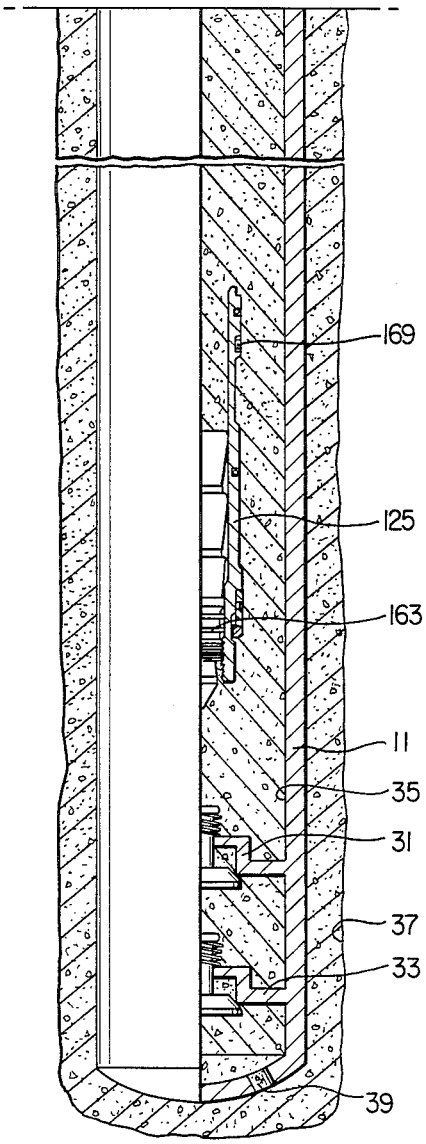
FIG. 4*e* is a downward continuation of FIG. 4*d* showing the first pump down plug having been sheared out from the bottom plug.

Another pump pressure increase of approximately 1,000 psi will now shear the second set of shear screws (155 in FIG. 1*b*) which holds the retaining ring 151. This action causes the snap ring 157 to pop out of the groove 159 and allows the bottom sleeve 125 and first pump down plug 163 to be released and fall to the bottom of the liner, thereby allowing circulation of cement through the bottom liner wiper plug 93, out the cementing ports 39 and into the annular space 37 as shown in FIG. 4*e*.

Figure 3A:
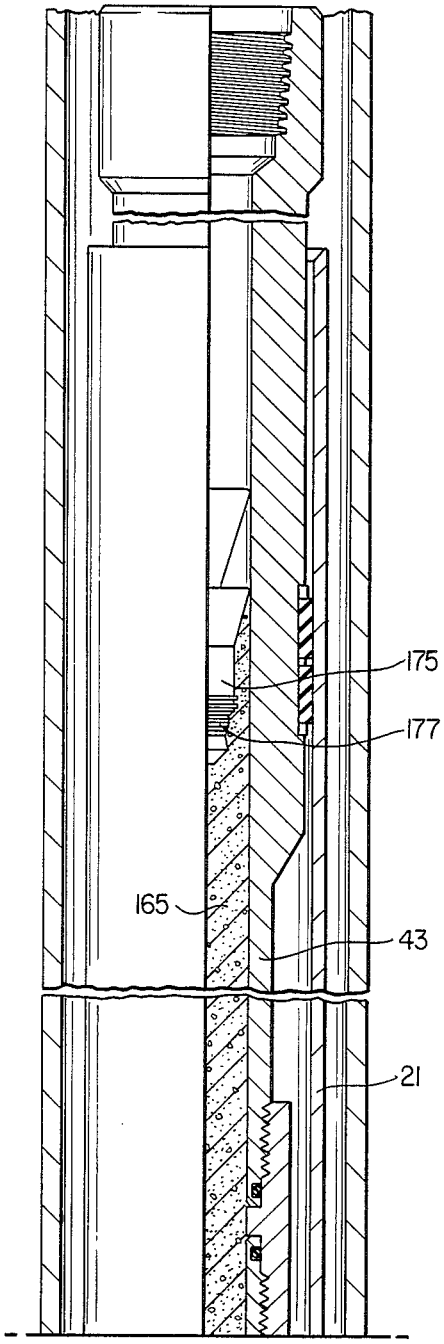
FIG. 3*a* is a view similar to FIG. 2*a* showing the second pump down plug which follows the column of cement.
Figure 3B:
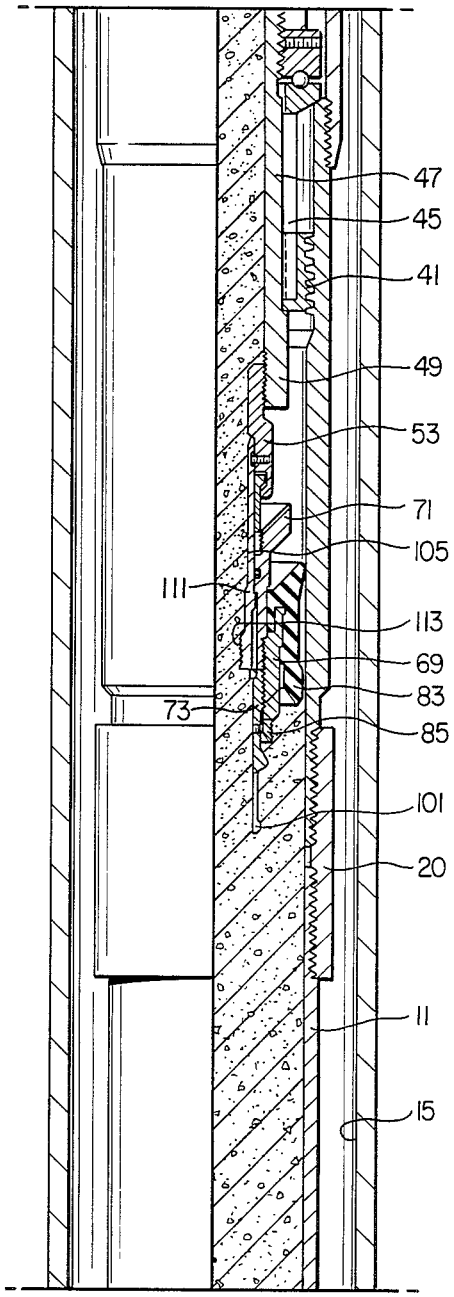
FIG. 3*b* is a view similar to FIG. 2*b* showing the plug assembly without the bottom plug.
Figure 3C:
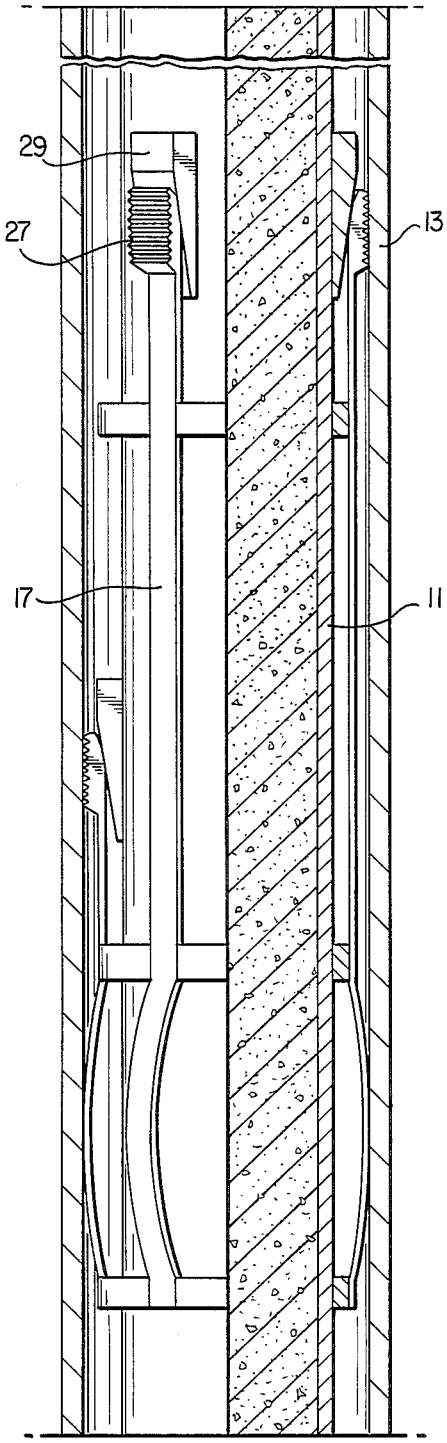
FIG. 3*c* is a downward continuation of FIG. 3*b*.
Figure 3D:
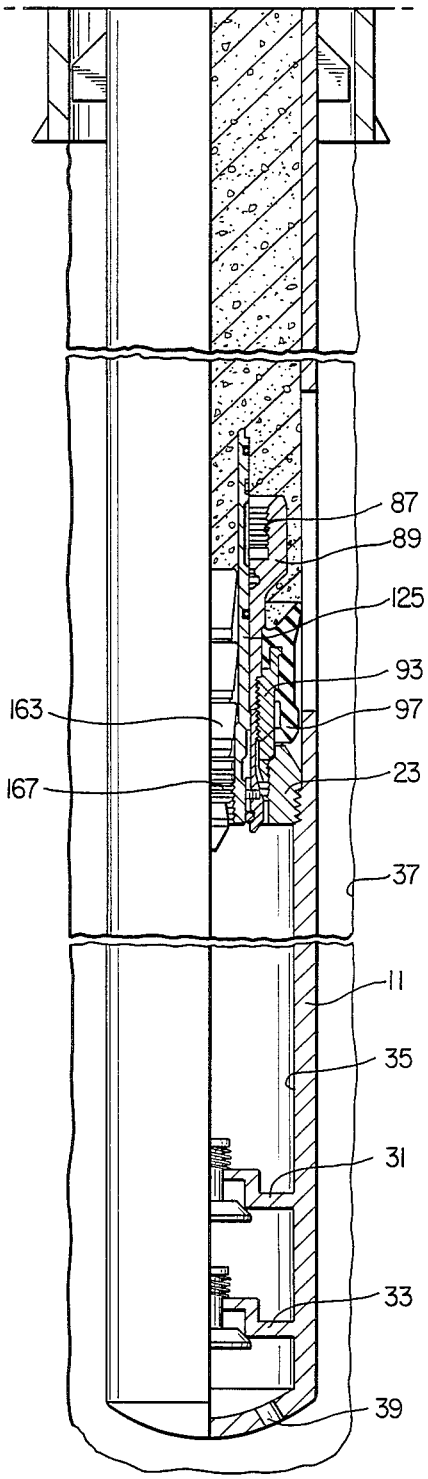
FIG. 3*d* is a downward continuation of FIG. 3*c* showing the bottom plug and first pump down plug seated within the landing collar of the liner.

As shown in FIG. 3*a*, a second pump down plug 175 is now dropped and pumped behind the column of cement 165. The second pump down plug 175 is pumped down by circulating fluid until the serrated surface 177 on the nose region thereof engages the serrated interior surface 113 of the top sleeve 105 (FIG. 3*b*). A 1,000 psi pump increase will then shear the third set of shear screws (119 in FIG. 1*a*) to release the top sleeve 105. Top sleeve 105 moves downwardly until the shoulder 115 contacts the mating shoulder 117, displacing the snap ring 121 and allowing the collet lugs 65 to spring free of the groove 63 in the plug carrying body 53. The top liner wiper plug 69, top sleeve 105 and second pump down plug 175 are then free to move down the liner string until the serrated surface (85 in FIG. 1*a*) of the top plug latches within the internal landing profile 87 provided in the bottom plug. FIG. 4*d* shows the second pump down plug 175 top sleeve 105 and top plug 69 latched within the landing profile of the bottom plug 91.

An invention has been provided with several advantages. The four plug cementing system of the invention completely isolates a column of cement from outside drilling mud and other contaminates. This is accomplished by having a plug both below and above the column of cement. The top liner wiper plug is positively locked to the plug carrying body of the setting tool until the bottom wiper plug has been sheared off the assembly. The positive lock provided by the longitudinally shiftable internal sleeve prevents premature shear of the top liner wiper plug. Both the top and bottom wiper plugs are positively locked to each other and to the setting tool until the pump down plugs land within their respective seats. As a result, premature shear of either the top or bottom wiper plugs is prevented during loading of the plug assembly at the well surface or during the release of the setting tool from the liner string during the first stages of the cement operation.

While the invention has been described in only one of its forms, it should be apparent to those skilled in the art that it is not so limited, but is susceptible to various changes and modifications without departing from the spirit thereof.

I claim:

1. An apparatus for cementing a liner string in a well bore, comprising:

a liner string insertible in a well bore;

an operating string of smaller diameter than the internal diameter of the liner string and insertible therein;

means connecting said operating string within the internal diameter of the liner string operable by rotation of the operating string to release the operating string form the liner;

a plug carrying body connected to the lowermost extent of the operating string;

a top plug having an interior;

a first pressure releasable collet latch securing the top plug to the plug carrying body whereby said top plug is releasably supported from the plug carrying body;

a longitudinally space bottom plug having an interior;

a second pressure releasable collet latch securing the bottom plug to the top plug, whereby said bottom plug is releasably supported from the top plug;

a longitudinally shiftable top sleeve located within the interior of the top plug for locking the top plug to the plug carrying body until the second pressure-releasable collet latch securing the bottom plus is released;

a longitudinally shiftable bottom sleeve located below the longitudinally shiftable top sleeve for initially locking the bottom plug to the top plug;

wherein the plug carrying body is provided with an internal recess and wherein the top plug is provided with a plurality of upwardly extending collet fingers, each of the collet finger terminating in a lug, the collet lugs being received within the internal recess when the top plug is secured to the plug carrying body; and wherein the top plug is also provided with a plurality of downwardly extending collet fingers, each of the fingers terminating in a lug, and wherein the bottom plug is provided with an internal recess, the downwardly extending lugs of the top plug being received within the internal recess of the bottom plug when the bottom plug is secured to the top plug.

2. The apparatus of claim 1, wherein the longitudinally shiftable bottom sleeve has an internal profile adapted to receive a first pump down plug propelled by pressure through the operating string to exert release pressure on the bottom sleeve, and wherein the bottom sleeve also has an exterior including a region of greater relative external diameter which initially underlies the downwardly extending collet lugs and a region of reduced external diameter, downward movement of the bottom sleeve serving to bring the region of reduced external diameter into registry with the collet lugs to allow release of the bottom plug from the top plug.

3. The apparatus of claim 2, wherein the top sleeve has an internal profile adapted to receive a second pump down plug of greater relative diameter than the first pump down plug, the second pump down plug being propelled by pressure through the operating string to exert release pressure on the top sleeve, the top sleeve having an exterior region which initially underlies the upwardly extending collet lugs, downward movement of the top sleeve serving to release the upwardly extending collet lugs and, in turn, the top plug from the plug carrying body.

4. The apparatus of claim 3, further comprising: a landing collar located in the liner string below the lowermost extent of the operating string, the landing collar being provided with a plug catching profile for catching the bottom plug upon release of the bottom plug from the top plug.

5. The apparatus of claim 4, wherein the bottom plug is provided with an internal landing profile which engages the top plug upon release of the top plug from the plug carrying body.

6. The apparatus of claim 5, further comprising:

a retaining ring located within the interior of the bottom plug for supporting the bottom sleeve and first pump down plug within the bottom plug after release of the bottom plug from the top plug, and shear means connecting the retaining ring within the bottom plug releasable upon pressuring the interior of the operating string to a further predetermined level, whereby the bottom sleeve and first pump down plug are releasable from the bottom plug to allow cement to be pumped through the bottom plug and through the liner.

7. A method for cementing a liner string in a well bore, comprising the steps, of:

running a liner string into the well bore to the desired depth of a running tool provided as a part of an operating string extending to the well surface, the operating string being of smaller diameter than the internal diameter of the liner string and insertible therein;

providing a plug carrying body on the lowermost extent of the operating string, a top plug releasably supported from the plug carrying body and bottom plug releasably supported from the top plug;

securing the top plug to the plug carrying body by means of a first pressure-releasable, top collet latch and securing the bottom plug to the top plug by means of a second pressure-releasable, bottom collet latch;

locking the bottom plug to the top plug by means of a longitudinally shiftable bottom sleeve, the bottom sleeve being provided with an internal profile adapted to receive a first pump down plug propelled by pressure through the operating string to exert release pressure on the bottom sleeve, the bottom sleeve also being provided with an exterior including a region of greater relative external diameter which initially underlies the bottom collet latch and a region of reduced external diameter, downward movement of the bottom sleeve serving to bring the region of reduced external diameter into registry with the bottom collet latch to allow release of the bottom plug from the top plug;

locking the top plug to the plug carrying body by means of a longitudinally shiftable top sleeve, the top sleeve being provided with an internal profile adapted to receive a second pump down plug of greater relative diameter than the first pump down plug, the second pump down plug being propelled by pressure through the operating string to exert release pressure on the top sleeve, the top sleeve being provided with an exterior region which initially underlies the top collet latch, downward movement of the top sleeve serving to release the top collet latch and, in turn, the top plug from the plug carrying body;

pumping a first pump down plug through the operating string from the well surface to release the bottom plug; and pumping a second pump down plug through the operating string from the well surface to release the top plug.

8. The method claim 7, further comprising the steps of:

providing a landing collar located in the liner string below the lowermost extent of the operating string, the landing collar being provided with a plug catching profile for catching the bottom plug upon release of the bottom plug from the top plug; and pumping the bottom plug down into engagement with the landing collar.

9. The method of claim 8, further comprising the steps of:

providing the bottom plug with an internal landing profile which engages the top plug upon release of the top plug from the plug carrying body; and pumping the top plug down into engagement with the bottom plug by engaging the top plug in the internal landing profile.

10. The method of claim 9, further comprising the steps of:

providing a retaining ring within the interior of the bottom plug for supporting the bottom sleeve and first pump down plug within the bottom plug after release of the bottom plug from the top plug, and connecting the retaining ring within the bottom plug with shear means which are releasable upon pressuring the interior of the operating string to a further, predetermined level with is greater than that necessary to pump the first pump down plug into position, whereby the bottom sleeve and first pump down plug are releasable from the bottom plug to allow cement to be pumped through the bottom plug and through the liner.

* * * * *